United States Patent [19]

Moores, Jr.

[11] Patent Number: 4,468,826

[45] Date of Patent: Sep. 4, 1984

[54] HAMMER-DRILL FOR MASONRY FASTENERS

[75] Inventor: Robert G. Moores, Jr., Reisterstown, Md.

[73] Assignee: Black & Decker Inc., Newark, Del.

[21] Appl. No.: 387,699

[22] Filed: Jun. 11, 1982

[51] Int. Cl.[3] ..... B25F 3/00

[52] U.S. Cl. ..... 7/158; 81/464; 408/36

[58] Field of Search ..... 7/158; 81/436, 464; 173/12, 50; 408/36; 279/1 A

[56] References Cited

U.S. PATENT DOCUMENTS

| | | | |
|---|---|---|---|
| 1,216,047 | 2/1917 | Backscheider | 408/36 |
| 2,838,962 | 6/1958 | Curtis | 408/36 |
| 3,484,114 | 12/1969 | Rodin | 81/436 X |
| 3,696,693 | 10/1972 | Bosten et al. | 81/464 |
| 3,932,904 | 1/1976 | Nilsson et al. | 7/158 |
| 3,937,119 | 2/1976 | Ernst . | |
| 3,965,510 | 6/1976 | Ernst | 7/158 |
| 4,303,357 | 12/1981 | Makar | 279/1 A X |

*Primary Examiner*—James G. Smith

*Attorney, Agent, or Firm*—R. B. Sherer; H. Weinstein; Charles E. Yocum

[57] ABSTRACT

A hammer-drill is adapted for drilling a hole in masonry and subsequently driving a threaded masonry fastener therein. The hammer-drill has a driving output shaft nested concentrically within a driving output sleeve. The shaft and sleeve both extend forwardly of the tool housing, and both are driven continuously by respective gearing in the tool. The sleeve, however, is driven at a substantially lower rpm than the shaft and at a higher torque. After the hole is drilled, a tubular member is releasably and drivingly coupled to the sleeve. The tubular member encloses the masonry drill bit, which is continually rotated, and the drill bit need not be removed from the tool to seat the fastener. The tubular member has a forward portion provided with a socket for the head of the masonry fastener.

24 Claims, 10 Drawing Figures

HAMMER-DRILL FOR MASONRY FASTENERS

FIELD OF THE INVENTION

The present invention relates to a power tool for repeated drilling and fastener driving operations, and more particularly, to a portable electric hammer-drill for drilling holes in concrete and subsequently driving a threaded masonry fastener therein.

BACKGROUND OF THE INVENTION 1. Field of the Invention

For use with concrete and other forms of masonry, a wide variety of anchors and fasteners have been developed. These anchors and fasteners may be installed manually or by use of a power tool. In recent years, a self-tapping concrete fastener has been developed and marketed. This fastener has external threads and is driven into a hole previously drilled in the concrete. The hole may be drilled by a masonry drill bit chucked in a power tool and driven at a relatively high rpm. 2. Description of the Prior Art If the same power tool is used for both the drilling and fastener driving operations, the masonry drill bit must be removed from the power tool or otherwise deactivated, and the fastener coupled to the power tool by means of a suitable adapter. If many fasteners are to be used, any repeated removal and/or re-insertion of an adapter into the power tool is inconvenient, time consuming and hence costly.

Another arrangement is disclosed in U.S. Pat. No. 3,965,510. There, a driving mandrel carrying a masonry drill bit is telescopically received within the body portion of a combination attachment for a conventional electric drill. The body may be alternately retracted and advanced relative to the mandrel. In the retracted position of the body, the mandrel and hence the drill bit are exposed for drilling the required hole. In the advanced position of the body, the drill bit (which is being continuously rotated) is enclosed by the body. The end of the body carries an adapter insert having a socket therein for receiving the head of the masonry fastener.

While the structure disclosed in this '510 patent facilitates rapid drilling in concrete and subsequent installation of the threaded masonry fasteners, nevertheless, the power tool is driven at a substantially constant speed for both the drilling and fastener driving operations. This is undesirable. Ideally, the fastener driving operation should be performed at a substantially lower rpm than the drilling operation; otherwise, the threads may become stripped and the fastener may not be anchored securely. If the power tool is a two-speed drill with a mechanical shifter, this disadvantage may be somewhat alleviated. However, the different speeds are usually selected for drilling purposes, not drilling and fastener driving purposes, and the lower speed is still not ideally suited for the subsequent fastener driving operation. Furthermore, the addition of speed selectors and associated mechanisms results in a more expensive power tool; and besides, the speed-changing operations are time consuming.

Moreover, if the power tool is provided with a well-known trigger-operated electronic circuit providing a substantially unlimited speed range, it will be difficult for the operator to maintain the selected lower speed during the fastener driving operation. Besides, the output torque falls off substantially at the lower speeds, and this is quite undesirable for a masonry fastener driving operation.

Additionally, power tools have been disclosed in which multiple driving spindles protrude from the tool housing for alternately driving various tool elements at different speeds. One example is the power tool disclosed in U.S. Pat. No. 1,216,047. However, these disclosures still require removal of the drill bit or other tool element; otherwise, the exposed drill bit, which is continually driven, would constitute a safety hazard. Thus, these disclosures appear to be impractical for a multi-purpose tool for repeated concrete drilling and fastener driving operations.

The prior art has also disclosed other combination tools, such as the combination drill and screwdriving tool of U.S. Pat. No. 3,932,904. In this '904 patent, an axially-displaceable sleeve may be retracted rearwardly and held in a stationary position while the drill bit is exposed for drilling a hole. After the hole is drilled, the sleeve may be advanced forwardly to enclose the drill bit. The sleeve is then locked to the driving spindle for driving a screw or other fastener into the drilled hole at the same speed. In this disclosure, the sleeve is always mounted on the core body and retained against complete removal therefrom. This configuration is not only impractical for deep hole drilling but is only suited to drive hex head fasteners, wherein the deep socket drive will allow the drill bit to pass through the drive socket when the driving sleeve is retracted. Fasteners having cross-slotted or slotted heads cannot be used in this system.

Thus, it will be appreciated that despite the numerous patents and commercial devices which are available, a totally practical solution to the problem has not been forthcoming.

SUMMARY OF THE INVENTION

Accordingly, it is an object of the present invention to alleviate the deficiencies and disadvantages of the prior art by providing an improved power tool for alternate drilling and fastener driving operations.

It is another object of the present invention to provide an improved hammer-drill for alternately drilling holes in concrete and subsequently driving threaded masonry fasteners or anchors therein.

It is yet another object of the present invention to provide a portable electric hammer-drill having a rotary output sleeve mounted concentrically about an output shaft, wherein responsive to operator actuation, the shaft and sleeve are driven continuously, and wherein the sleeve is driven at a lower rpm ideally suited for a fastener driving operation.

It is a further object of the present invention to provide an attachment comprising an elongated tubular member drivingly coupled to the rotary output sleeve after the hole has been drilled, the tubular member substantially enclosing the continually-rotating drill bit, and the tubular member having socket means on its end for receiving the head of the threaded masonry fastener.

It is a still further object of the present invention to provide a substantially lighter weight, less complex tool than similar tools now in use.

It is a yet still further object of the present invention to eliminate any necessity for removing the drill bit from the tool, or for reversing an adapter end-to-end, or for changing the gearing ratios in the power tool.

It is again a further object of the present invention to facilitate the rapid drilling of a large number of holes in concrete and the subsequent installation of threaded fasteners therein, thereby effecting a substantial savings of time.

In accordance with the broad teachings of the present invention, a power tool has a housing with first and second spindle means rotatably journaled therein. Both spindle means are driven continuously, and the second spindle means is driven at a substantially lower rpm than the first spindle means. A drill bit is drivingly coupled to the first spindle means for drilling a hole in a workpiece. After the hole is drilled, an attachment means is mounted on the tool and is drivingly coupled to the second spindle means. The attachment means substantially encloses the drill bit, which is continuously driven, and a fastener means is mounted on the other end of the attachment means. As a result, the fastener is connected to the attachment means without requiring removal of the bit.

In accordance with the further teachings of the present invention, a portable electric hammer-drill has a continuously-rotating sleeve mounted concentrically about the output shaft and driven at a substantially lower rpm than the output shaft. The attachment means comprises an elongated tubular member fitted over the sleeve and drivingly coupled thereto, and an adapter is received on the end of the tubular member. The fastener means comprises an externally-threaded masonry fastener, and the fastener has a head configuration which fits a corresponding configuration on the adapter. The tubular member is driven by the output sleeve of the hammer-drill at a substantially lower rpm, but at a proportionally higher torque, for optimum driving of the fastener into the drilled hole.

Additionally, the hammer-drill has a mechanism for superimposing on the rotating masonry bit a relatively high frequency of vibratory impact blows, which substantially assists in drilling holes in concrete; and no gear shifting in the hammer-drill is necessary for the subsequent masonry fastener driving operations. As a result, operator convenience is considerably enhanced, and a substantial time savings is realized where a large number of fasteners are required.

These and other objects of the present invention will become apparent from a reading of the following specification, taken in conjunction with the enclosed drawings.

DESCRIPTION OF THE PREFERRED EMBODIMENT

Figure 1:
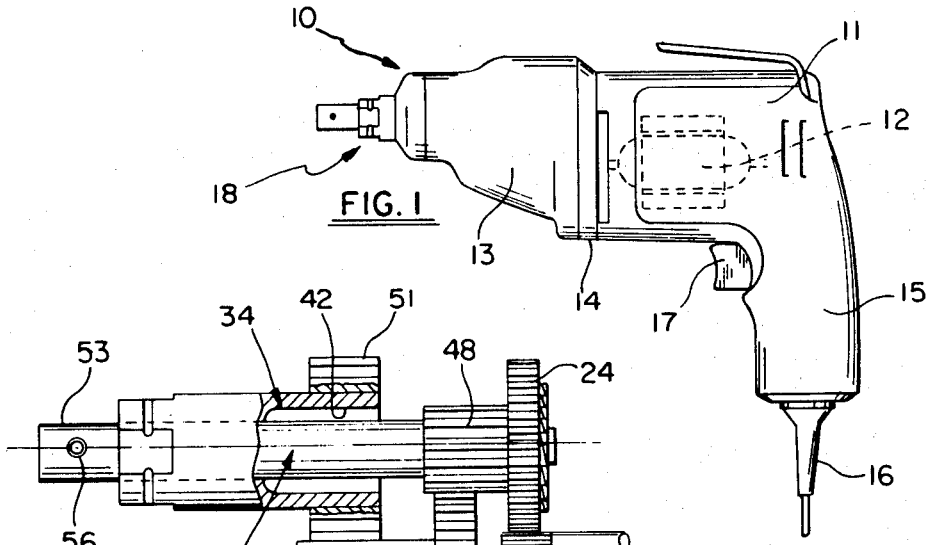
FIG. 1 is a side elevation of one embodiment of the present invention, showing an improved power tool intended specifically for drilling holes in concrete and installing masonry fasteners therein.

With reference to FIG. 1, there is illustrated a portable electric hammer-drill 10 with which the teachings of the present invention may find more particular utility. However, it will be appreciated that the scope of the present invention is not necessarily restricted thereto, and that the teachings of the present invention are equally applicable to a wide variety of power tools and other devices. With this in mind, the hammer-drill 10 generally comprises a motor housing 11, a motor 12 (shown in broken lines) in the motor housing 11, a gear case 13 secured forwardly of the motor housing 11, a gear case cover 14 between the gear case 13 and the motor housing 11, a pistol-grip handle 15 mounted rearwardly of the motor housing 11, a line cord 16, a trigger 17 carried by the handle 15 for selectively energizing the motor 12, and output spindle means generally denoted by 18. If desired, the hammer-drill 10 may be provided with an auxiliary handle mounted on the gear case and circumferentially adjustable thereon to suit the convenience of the individual operator; however, the auxiliary handle forms no part of the present invention and hence has been omitted for ease of illustration.

Figure 2:
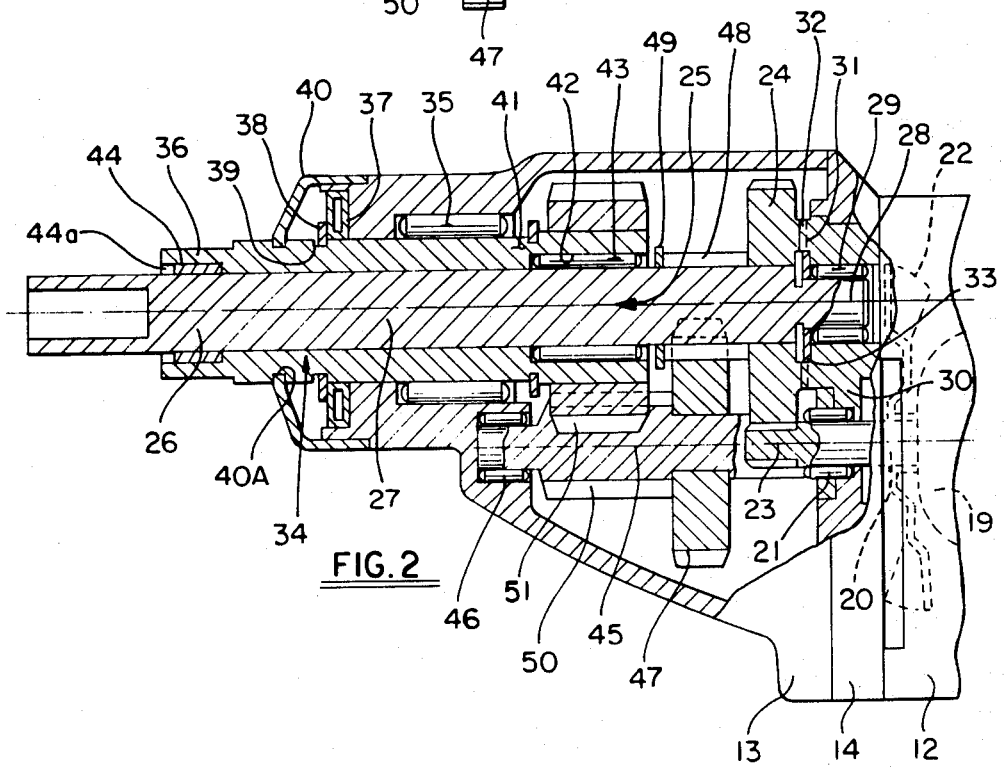
FIG. 2 is an enlarged portion of FIG. 1, with parts broken away and sectioned, showing the mechanism of the preferred embodiment.

With reference to FIG. 2, the motor 12 has an armature 19 (shown in broken lines) provided with a shaft 20 journaled in a bearing 21 in the gear case cover 14. The armature shaft 20 carries a conventional fan 22 (shown in broken lines) for purposes of cooling the motor 12. A pinion 23 is formed on the end of the armature shaft 20, and the pinion 23 meshes with a gear 24 press-fitted (or suitably keyed) to a driving output shaft 25. This driving output shaft 25, which comprises a first driving spindle means, has a forward portion 26, an intermediate portion 27, and a reduced rearward portion 28, the latter being journaled in a bearing 29. Bearing 29 is mounted concentrically within a stationary hammer member 30 retained in the gear case cover 14. The stationary hammer member 30 has a plurality of circumferentially-spaced hammer teeth 31 extending forwardly therefrom. Hammer teeth 31 on the stationary hammer member 30 cooperate with similar hammer teeth 32 formed on the gear 24 and extending rearwardly therefrom. A coil spring 33 is seated between the cooperating hammer teeth 31, 32, concentrically of the shaft 25, for biasing the shaft 25 forwardly of the tool 10. The shaft 25 is mounted in the housing for limited axial floating movement therein, and the cooperating hammer teeth 31,32 have a repeated ratcheting action therebetween to impart relatively high frequency vibratory hammer blows to the shaft 25. This is the typical operation of a conventional hammer-drill.

Figure 3:
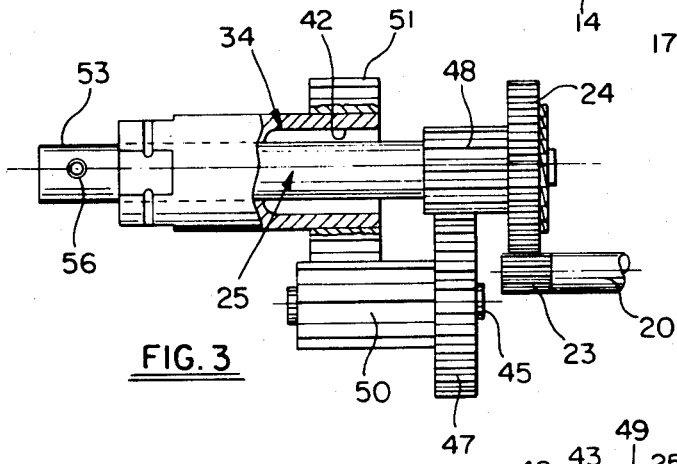
FIG. 3 is a plan layout of the gearing arrangement of FIG. 2.

With reference again to FIG. 2, and with further reference to FIG. 3, a driving output sleeve 34 is journaled in a bearing 35 in the gear case, concentrically of the shaft 25. This driving output sleeve 34, which comprises a second driving spindle means, has a forward portion 36 within which the forward portion of the shaft 25 is concentrically nested. The respective forward portions 26, 36 of the shaft 25 and sleeve 34 project beyond the housing, and the shaft portion 26 extends forwardly of the sleeve portion 36. A dust seal 37 is retained by a ring 38 carried in a groove 39 on the sleeve. A nose piece or cover 40 is snapped over the gear case 13, radially of the sleeve 34, and is retained in a groove 40A on the sleeve. The sleeve 34 has a rearward portion 41 with a blind axial bore 42 formed therein. Roller bearing 43 is mounted in the blind axial bore 42, radially between the rearward portion of the sleeve 34 and the intermediate portion of the shaft 25. A sleeve bearing 44 is inserted in the forward portion 36 of shaft 25. An annular seal 44a is mounted adjacent at the end of the forward portion 36.

An intermediate spindle 45 is rotatably journaled in respective bearings in the gear case 13 (one of which is shown as at 46) about an axis radially offset from the axis of the shaft 25. This intermediate spindle carries a gear 47, keyed thereto, which meshes with a pinion 48. The pinion 48 is carried on the intermediate portion of shaft 25, is keyed thereto, and is retained against axial movement by a snap ring 49. The intermediate spindle 45 also has a pinion 50 formed thereon, and the pinion 50 meshes with a gear 51 carried by the rearward portion of sleeve 34 and keyed thereto.

With this arrangement, it will be appreciated that the shaft 25 and sleeve 34 are both continuously rotated, but that the sleeve 34 is driven at a substantially lower number of revolutions per minute ("rpm") than the shaft 25 (and at a correspondingly higher torque). In a preferred embodiment, the shaft 25 rotates at 4000 rpm, and the sleeve 34 rotates at 525 rpm. Moreover, the concentrically-mounted shaft 25 and sleeve 34 together with their respective gearing means, first from the motor to the shaft, and second, from the shaft to the sleeve via the intermediate gearing (47–50), results in a relatively compact overall structure, one that fits within the contours of a portable hammer-drill without requiring bulky housings or attachments.

Figures 4, 5, 6, 7, 8, 9, 10:
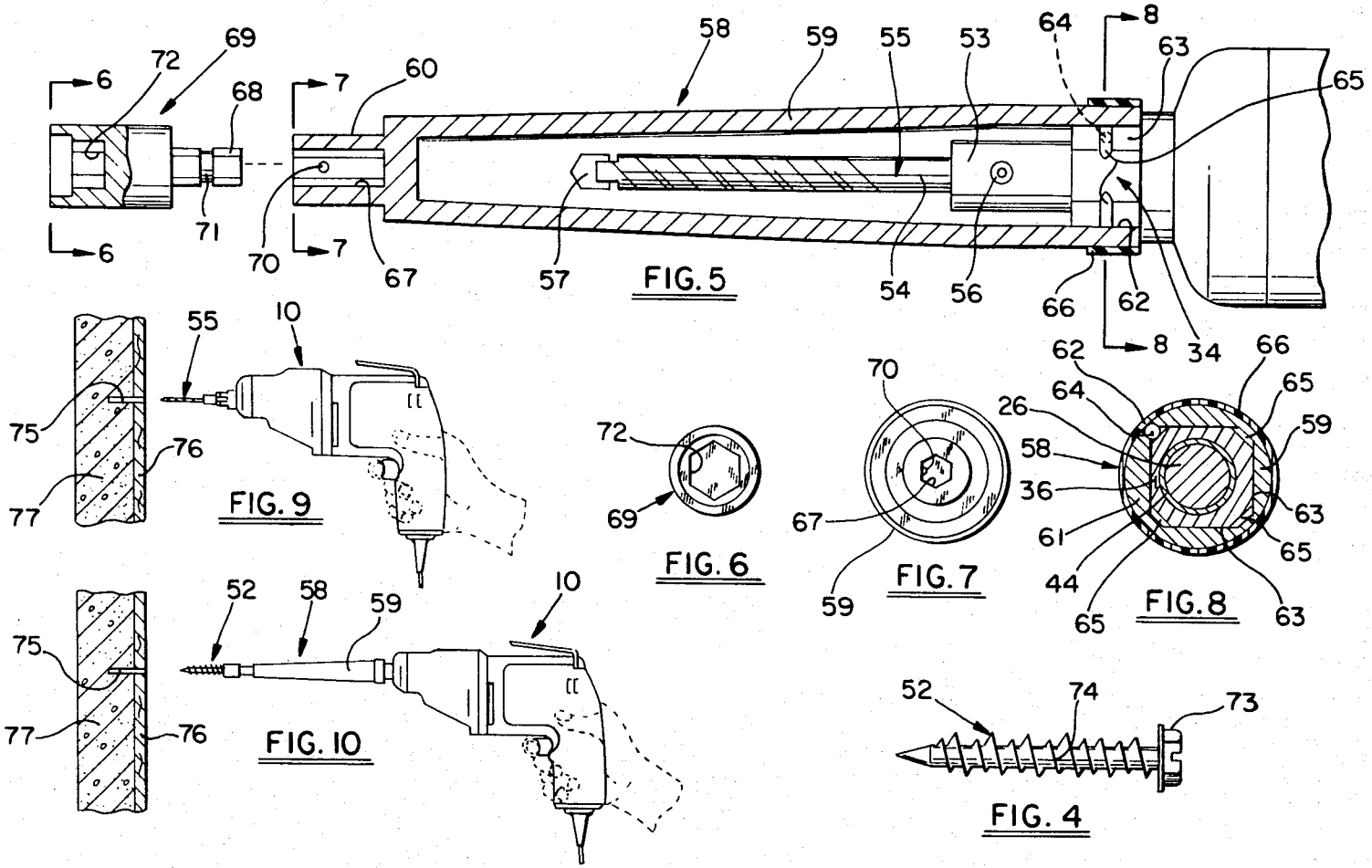
FIG. 4 is an elevation of a masonry fastener for use with the present invention.
FIG. 5 is an exploded view, partially in elevation and partially in section, showing a tubular attachment drivingly coupled to the tool (and enclosing the masonry bit) after the drilling operation, and further showing an adapter intended to be coupled to the end of the tubular attachment, the adapter having a socket for receiving the head of the masonry fastener.
FIG. 6 is a view taken along the lines 6—6 of FIG. 5, showing the socket end of the adapter in elevation.
FIG. 7 is a view taken along the lines 7—7 of FIG. 5, showing the end of the tubular attachment in elevation.
FIG. 8 is a section view, taken across the lines 8—8 of FIG. 5, showing the means for drivingly coupling the tubular attachment to a concentric driving sleeve on the tool.
FIG. 9 illustrates the use of the power tool for drilling a hole, prior to securing a stud on a concrete wall.
FIG. 10 i11ustrates the use of the power tool and its tubular attachment for subsequently driving the masonry fastener in the drilled hole.

With reference to FIG. 4, there is illustrated a typical threaded masonry fastener 52 which may be ideally driven by the structure of the present invention. The fastener 52, which is disclosed in U.S. Pat. No. 3,937,119, forms no part of the present invention. Conversely, the present invention is not restricted to the particular fastener 52, but rather is equally applicable to a wide variety of related fasteners, anchors and inserts for masonry and other materials.

With reference to the FIGS. 5–8, the output shaft 25 carries a chuck 53. The shank 54 of a conventional masonry drill bit 55 is received in the chuck and is retained by a set screw (or Allen screw) 56. The end of the bit is provided with a hardened carbide tip 57 for percussion-drilling purposes. After the hole has been drilled, the tool 10 is turned off, and an attachment 58 is coupled to the tool 10. The attachment 58 comprises an elongated tubular member 59 which is tapered forwardly and terminates in a reduced-diameter forward end portion 60. The tubular member 59 is preferably made of steel (although other materials are feasible) and hence is sometimes referred to as a "drive steel". A rearward end portion 61 of the tubular member 59 has an octogonal-type of socket 62 received over corresponding flats 63 formed on the extending portion of the driving sleeve 34, thereby drivingly coupling the sleeve 34 to the tubular member 59. However, any mating geometric configuration suitable for providing a driving coupling between the sleeve 34 and the tubular member 59 would be acceptable, such as a four-sided polygon. Also, it is not necessary that the polygonal configuration, if used, has an equilateral shape. A ball detent 64 carried by the socket 62 on the tubular member 59 is received in one of a series of external grooves 65 formed on four of the flats 63 on the sleeve 34 (as shown in FIG. 8) for retaining the tubular member 59 against inadvertent axial displacement. With this structure, the tubular member 59 may be quickly attached to (or removed from) the driving sleeve 34 with a "snap action". A band 66 is carried by the rearward end of the tubular member 59 to provide force for biasing the ball detent 64. It should be noted that other means for providing a "snap-action" are within the contemplation of this invention.

The tubular member 59 completely encloses the continuously-rotating masonry bit 55, thereby eliminating exposure of the bit 55, and the length of the tubular member 59 is sufficient to accommodate the longest masonry bit intended to be used with the hammer drill 10.

The reduced forward end portion 60 of the tubular member 59 has a polygonal socket 67 for receiving the corresponding shank 68 of an adapter 69. A ball detent 70 in the socket 67 is received in an external annular groove 71 on the shank 68, thereby retaining the adapter 69 against inadvertent displacement. The adapter 69 has a polygonal socket 72 for receiving the corresponding head 73 of the masonry fastener 52. It will be appreciated that several adapters may be employed in an overall kit to accommodate the respective heads of a range of fastener sizes. The fastener 52 has external threads 74 for driving the fastener into a drilled hole 75 in the masonry and securely anchoring the fastener 52 therein.

With reference to FIGS. 9 and 10, the sequence of operations is illustrated. In FIG. 9, the hammer-drill 10 is used to drill the hole 75 through both a wood stud 76 and a concrete wall 77. After the hole 75 has been drilled, the tubular member 59 is slipped over the hammer-drill 10, covering the rotating bit 55, and is coupled to the concentric driving sleeve 34. The fastener 52 is received in its socket 72, and the fastener 52 is driven into the hole 75 (as shown in FIG. 10) thereby securing the stud 76 to the concrete wall 77.

With this arrangement, a single hole 75 (or a number of holes) may be drilled in the concrete 77, and the use of the hammer-drill 10 substantially reduces the drilling time. Thereafter, the attachment 58 may be quickly fitted over the tool 10 to drive the threaded fasteners 52 into the holes. It is not necessary to remove the drill bit 55 from the tool, nor is it necessary to axially advance a body telescoped over the drill bit 55. Although the drill bit 55 will be rotated continually, it is totally enclosed by the attachment 58. No gear shifting within the hammer-drill 10 is required. The driving output sleeve 34 rotates at an rpm which is substantially lower than the rpm of the driving output shaft 25, and at a proportionally higher torque, both of which are ideally suited to the masonry fastener driving operation. The respective gearing for the driving shaft 25 and sleeve 34 have been specially designed for optimum drilling and driving performance, respectively. The attachment 58 may be quickly removed, the drill bit 55 is already in place, and the operator may proceed to the next hole 75 (or cluster of holes) to be drilled. The process may be repeated, resulting in a considerable time savings where a large nun er of fasteners are required.

Obviously, many modifications may be made without departing from the basic spirit of the present .nvention. Accordingly, it will be appreciated by those skilled in the art that within the scope of the appended claims, the invention may be practiced other than has been specifically described herein.

I claim:

1. A hand-held, portable drill, comprising:
(a) a housing;
(b) a motor mounted in the housing and having a drive shaft;
(c) an output shaft rotatably connected in the housing about a first axis and driven by the drive shaft at a first speed;
(d) a sleeve rotatably journaled in the housing concentric with the output shaft;
(e) the sleeve and output shaft having respective concentric forward portions extending beyond the housing;
(f) the output shaft forward portion including means for drivingly engaging a tool bit;
(g) a tubular fastener-driving member releasably and drivingly connected to sleeve forward portion and noncontactingly enclosing the tool bit;
(h) a spindle rotatably connected in the housing about a second axis parallel to the first axis; and
(i) coupling means for drivingly connecting the output shaft to the sleeve via the spindle to rotate the sleeve at a second, lower speed.

2. The drill claimed in claim 1, wherein the coupling means further drives the sleeve continuously with the output shaft.

3. The drill claimed in claim 1, wherein the coupling means includes an axially-stationary gear cluster.

4. The drill claimed in claim 1, wherein the coupling means includes a maximum of four gears.

5. The drill claimed in claim 1, further comprising:
(a) speed reduction means for drive-connecting the motor drive shaft with the output shaft; and
(b) the speed reduction means and the coupling means together defining a triple speed reduction between the motor drive shaft and the output shaft.

6. The drill claimed in claim 1, wherein:
(a) the sleeve has a rearward poriton;
(b) the sleeve rearward portion defines a blind axial bore therein; and further comprising
(c) a bearing mounted in the bore radially between the output shaft and the sleeve.

7. The drill claimed in claim 1, wherein:
(a) the coupling means including a first drive shaft gear, first and second spindle gears, and a sleeve gear;
(b) the first spindle gear drivingly engaging the drive shaft gear; and
(c) the second spindle gear drivingly engaging the sleeve gear.

8. The drill claimed in claim 7, wherein:
(a) the sleeve having a rearward portion; and
(b) the sleeve gear being mounted on the sleeve rearward portion coaxial with the output shaft.

9. The drill claimed in claim 8, further comprising:
(a) a second drive shaft gear drivingly connected to the motor drive shaft; and wherein
(b) the first drive shaft gear is located axially intermediate the sleeve gear and the second drive shaft gear.

10. The drill claimed in claim: 8, wherein:
(a) the sleeve rearward portion defining a blind axial bore; and further comprising
(b) a bearing mounted in the bore adjacent the sleeve gear, radially between the sleeve and the output shaft.

11. A hand-held, portable drill, comprising:
(a) a housing;
(b) a motor mounted in the housing and having a drive shaft;
(c) an output shaft rotatably connected in the housing about a first axis, and driven by the drive shaft at a first speed;
(d) a sleeve rotatably journaled in the housing concentric with the output shaft;
(e) the sleeve and output shaft having respective concentric forward portions extending beyond the housing;
(f) the output shaft forward portion including means for drivingly engaging a tool bit;
(g) a tubular fastener-driving member releasably and drivingly connected to the sleeve forward portion and noncontactingly enclosing the tool bit;
(h) the fastener-driving member including a rearward portion having means for connecting and disconnecting the fastener-driving member to and from, respectively, the sleeve forward portion with a single axial, nonrotating snap-action motion;
(i) a spindle rotatably connected in the housing about a second axis parallel to the first axis; and
(j) coupling means for drivingly connecting the output shaft to the sleeve via the spindle to rotate the sleeve at a second, lower speed.

12. The drill claimed in claim 11, wherein the means for connecting and disconnecting the fastener-driving member including mating geometric configurations formed on an inner surface of the fastener-driving member and on an outer surface of the sleeve forward portion, respectively.

13. The drill claimed in claim 12, further comprising:
(a) a groove formed in the outer surface of the forward portion of the sleeve adjacent the sleeve geometric configuration; and
(b) a ball detent adjacent the fastener-driving member geometric configuration and engagable with the groove.

14. The drill claimed in claim 13, further comprising means on the fastener-driving member for normally biasing the ball detent into engagement with the groove.

15. The drill claimed in claim 14, wherein the means for biasing including a band carried by the fastener-driving member rearward portion and engaging the ball detent.

16. The drill claimed in claim 11, wherein:
(a) the fastener-driving member further including a reduced-diameter forward end portion;
(b) the forward end portion including means for releasably engaging an adapter; and
(c) the adapter including socket means for drivingly engaging a fastener.

17. A hand-held, portable hammer-drill, comprising:
(a) a housing;
(b) a motor mounted in the housing and having a drive shaft;

(c) an output shaft rotably connected in the housing about a first axis for limited axial hammering movement, and driven by the drive shaft at a first speed;
(d) hammer means operatively associated with the output shaft for imparting axial hammer blows to the output shaft;
(e) a sleeve rotatably journaled in the housing concentric with the output shaft;
(f) the sleeve and output shaft having respective concentric forward portions extending beyond the housing;
(g) the output shaft forward portion including means for drivingly engaging a tool bit;
(h) a tubular fastener-driving member releasably and drivingly connected to the sleeve forward portion and noncontactingly enclosing the tool bit;
(i) a spindle rotatably connected in the housing about a second axis parallel to the first axis; and
(j) coupling means for drivingly connecting the output shaft to the sleeve via the spindle to rotate the sleeve at a second, lower speed.

18. The hammer-drill claimed in claim 17, wherein:
(a) the output shaft having a rearward portion; and further comprising
(b) a gear mounted on the output shaft rearward portion and drive-connected to the motor drive shaft.

19. The hammer-drill claimed in claim 18, wherein:
(a) the hammer means including a stationary hammer member fixedly connected in the housing having a plurality of circumferentially-spaced hammer teeth extending forwardly therefrom; and
(b) the hammer means further including hammer teeth on the gear cooperating with the fixed hammer teeth, and spring means connected between the cooperating hammer teeth concentrically on the output shaft for biasing the output shaft forwardly of the housing.

20. the hammer-drill claimed in claim 17, wherein:
(a) the output shaft rearward portion having a reduced diameter portion;
(b) a bearing being fixedly connected in the housing; and
(c) the output shaft reduced diameter portion being journaled in the bearing, thereby limiting the axial movement of the output shaft.

21. The hammer-drill claimed in claim 20, further comprising means for preventing axial movement of the sleeve relative to the housing.

22. The hammer-drill claimed in claim 17, further comprising means for maintaining the output shaft forward portion projecting beyond the sleeve forward portion.

23. A hand-held, portable hammer-drill, comprising:
(a) a housing;
(b) a motor mounted in the housing and having a drive shaft;
(c) an output shaft rotatably connected in the housing and driven by the drive shaft at a first speed, and further being connected for limited axial movement;
(d) hammer means for imparting axial hammer blows to the output shaft;
(e) a sleeve rotatably journaled in the housing concentric with the output shaft;
(f) the sleeve and output shaft having respective concentric forward portions extending beyond the housing;
(g) the output shaft forward portion including means for drivingly engaging a tool bit;
(h) a tubular fastener-driving member releasably and drivingly connected to the sleeve forward portion and enclosing the tool bit;
(i) the fastener-driving member including a rearward portion having means for connecting and disconnecting the fastener-driving member to and from, respectively, the sleeve forward portion with a single axial, nonrotating snap-action motion; and
(j) means for driving the sleeve from the output shaft at a second, lower speed continuously with the output shaft.

24. A band-held, portable hammer-drill, comprising:
(a) a housing;
(b) a motor mounted in the housing and having a drive shaft;
(c) an output shaft rotatably connected in the housing about a first axis for limited axial hammering movement, and driven by the drive shaft at a first speed;
(d) hammer means operatively associated with the output shaft for imparting axial hammer blows to the output shaft;
(e) a sleeve rotatably journaled in the housing concentric with the output shaft;
(f) the sleeve and output shaft having respective concentric forward portions extending beyond the housing;
(g) the output shaft forward portion including means for drivingly engaging a tool bit;
(h) a tubular fastener-driving member releasably and drivingly connected to the sleeve forward portion and noncontactingly enclosing the tool bit;
(i) the fastener-driving member including a rearward portion having means for connecting and disconnecting the fastener-driving member to and from, respectively, the sleeve forward portion with a single axial, nonrotating snap-action motion;
(j) a spindle rotatably connected in the housing about a second axis parallel to the first axis; and
(k) coupling means for drivingly connecting the output shaft to the sleeve via the spindle to rotate the sleeve at a second, lower speed.

* * * * *